US009475293B2

(12) United States Patent
Tanda

(10) Patent No.: US 9,475,293 B2
(45) Date of Patent: Oct. 25, 2016

(54) RECOVERY SYSTEM FOR RECORDING HEAD, INK-JET RECORDING APPARATUS INCLUDING THE SAME, AND RECOVERY METHOD FOR THE RECORDING HEAD

(71) Applicant: KYOCERA Document Solutions Inc., Osaka (JP)

(72) Inventor: Tetsuo Tanda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/017,139

(22) Filed: Feb. 5, 2016

(65) Prior Publication Data

US 2016/0243836 A1 Aug. 25, 2016

(30) Foreign Application Priority Data

Feb. 19, 2015 (JP) ..... 2015-030249

(51) Int. Cl.
*B41J 2/165* (2006.01)

(52) U.S. Cl.
CPC ..... *B41J 2/16535* (2013.01)

(58) Field of Classification Search
None
See application file for complete search history.

(56) References Cited

U.S. PATENT DOCUMENTS 6,257,697 B1 7/2001 Kurata ..... 347/33
2014/0340447 A1* 11/2014 Ito ..... B41J 2/16535 347/33

FOREIGN PATENT DOCUMENTS

JP 7-246710 A 9/1995

* cited by examiner

*Primary Examiner* — Alejandro Valencia
(74) *Attorney, Agent, or Firm* — Stein IP, LLC

(57) ABSTRACT

A recovery system for a recording head of the present disclosure includes a wiper, a drive mechanism, a first rotary mechanism, and a control portion. The first rotary mechanism causes the wiper to rotate. The control portion is capable of executing the recovery operation of a recording head including an ink push-out operation in which ink is forcibly pushed out, a first wipe-off operation in which purged ink is wiped off, a rotary moving-away operation in which, while being caused to move in a first direction, the wiper is caused to rotate toward an obliquely lower side in a second direction opposite to the first direction, thus moving away from the ink discharge surface, and a second wipe-off operation in which ink is wiped off by causing the wiper to move in the second direction.

4 Claims, 14 Drawing Sheets

RECOVERY SYSTEM FOR RECORDING HEAD, INK-JET RECORDING APPARATUS INCLUDING THE SAME, AND RECOVERY METHOD FOR THE RECORDING HEAD

INCORPORATION BY REFERENCE

This application is based on the corresponding Japanese Patent Application No. 2015-030249 filed on Feb. 19, 2015.

BACKGROUND

This disclosure relates to a recovery system for a recording head having a discharge nozzle that discharges ink onto a recording medium such as a paper sheet, an ink-jet recording apparatus including the same, and a recovery method for the recording head.

As a recording apparatus such as a facsimile, a copy machine, or a printer, an ink-jet recording apparatus that discharges ink to form an image has been widely used since it is capable of forming high-definition images.

In such an ink-jet recording apparatus, there may occur deterioration of straightness of ink (flying curve), discharge failure, or the like, resulting in degradation in printing performance of a recording head. A possible cause of this is that meniscus abnormality occurs due to a foreign object such as paper powder, dirt, or dust generated at a time of conveyance of a paper sheet (recording medium), a minute ink droplet (hereinafter, referred to as a mist) discharged together with an ink droplet for image recording, or a mist bounced when the ink droplet adheres to the recording medium, being attached to an ink discharge surface of the recording head. Another possible cause is that the mist adheres to a cap mounting portion and becomes dry there, resulting in a decrease in hermeticity at a time of mounting a cap to the cap mounting portion, and still another possible cause is that, as a result of the decrease in hermeticity, part of the ink in a nozzle increases in viscosity.

In order, therefore, to prevent drying of the ink in the discharge nozzle whose opening is provided at the ink discharge surface of the recording head and clogging of the nozzle due to part of the ink in the discharge nozzle increasing in viscosity, a configuration has been used in which, after the ink is forcibly pushed out (purged) from the nozzle, purged ink adhering to the ink discharge surface (nozzle surface) is wiped off by a wiper, which is how a recovery operation of the recording head is performed.

SUMMARY

A recovery system for a recording head according to one aspect of the present disclosure is a recovery system for a recording head that has a nozzle region in which a discharge nozzle that discharges ink onto a recording medium is open. The recovery system includes a wiper, a drive mechanism, a first rotary mechanism, and a control portion. The wiper wipes off purged ink forcibly pushed out from the discharge nozzle. The drive mechanism drives the wiper to reciprocate along an ink discharge surface including the nozzle region. The first rotary mechanism causes the wiper to rotate in such a direction as to move away from the ink discharge surface. The control portion controls pushing out and discharging of ink from the discharge nozzle and an operation of the drive mechanism. The control portion is capable of executing a recovery operation of the recording head. The recovery operation of the recording head includes an ink push-out operation in which ink is forcibly pushed out from the discharge nozzle so that purged ink adheres to the nozzle region, a first wipe-off operation in which, after the wiper is brought in press-contact with a first position on an outer side of the nozzle region on the ink discharge surface, the wiper is caused to move, in a state of being in press-contact with the ink discharge surface, in a first direction directed to a nozzle region side along the ink discharge surface, thus wiping off the purged ink, a rotary moving-away operation in which, at a second position on an opposite side to the first position with respect to the nozzle region on the ink discharge surface, while being caused to move in the first direction, the wiper is caused to rotate toward an obliquely lower side in a second direction opposite to the first direction, thus moving away from the ink discharge surface, and a second wipe-off operation in which, after the rotary moving-away operation, in a state of being in press-contact with the ink discharge surface, the wiper is caused to move in the second direction along the ink discharge surface from a position on an opposite side to the nozzle region with respect to the second position, thus wiping off ink at the second position.

Still other objects of the present disclosure and specific advantages provided by the present disclosure will be made further apparent from the following description of an embodiment.

BRIEF DESCRIPTION OF THE DRAWINGS

FIG. 6 is a diagram showing a structure of the recording portion, a cap unit, a wipe unit, and so on.

DETAILED DESCRIPTION

The following describes an embodiment of the present disclosure with reference to the appended drawings.

Figure 1:
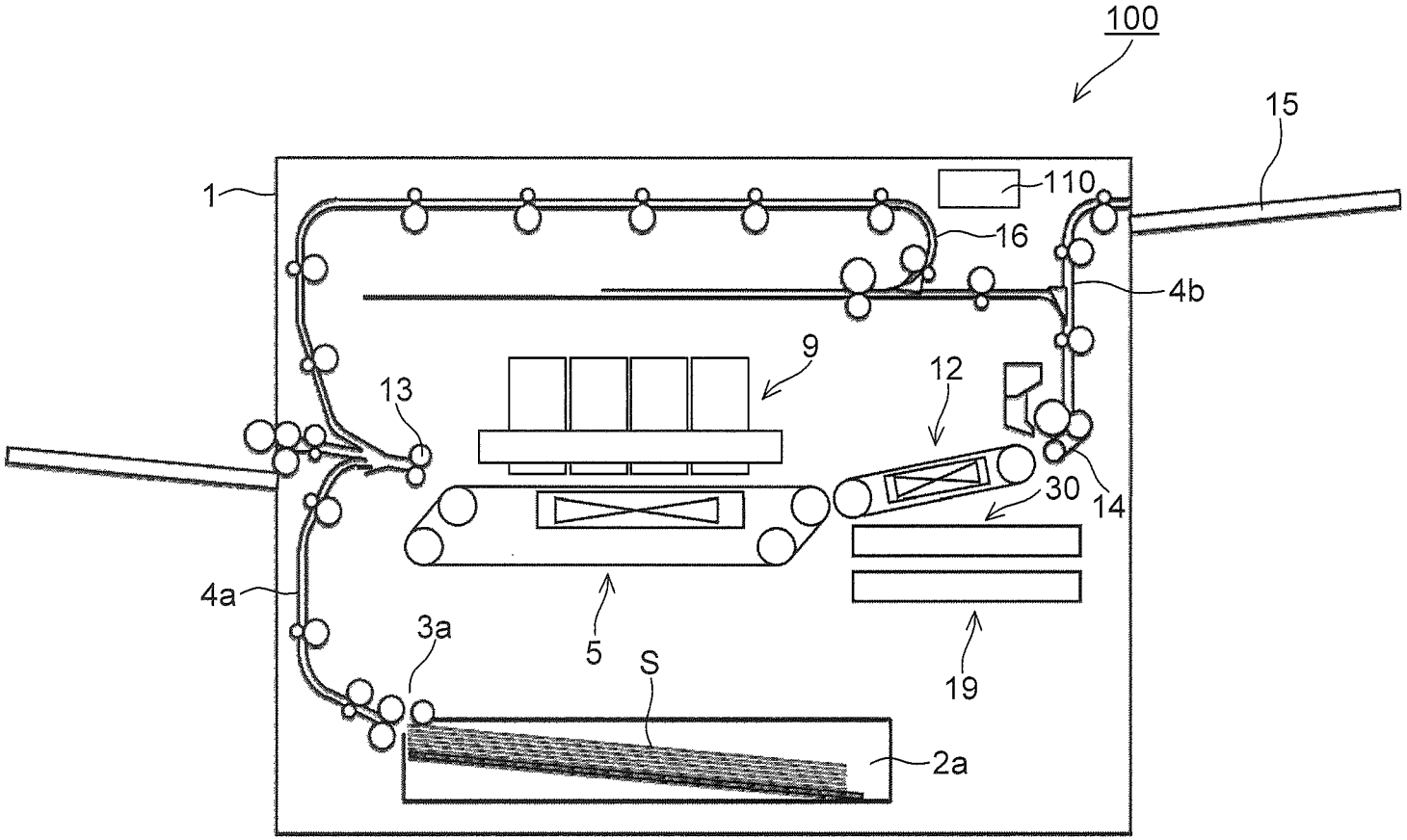
FIG. 1 is a diagram showing a structure of an ink-jet recording apparatus according to one embodiment of the present disclosure.

With reference to FIG. 1 to FIG. 27, a description is made of an ink-jet type printer 100 (ink-jet recording apparatus) of one embodiment of the present disclosure. As shown in FIG. 1, in the printer 100, a paper feed cassette 2*a* that is a paper sheet housing portion is disposed on a lower side inside a printer main body 1. Inside the paper feed cassette 2*a*, a paper sheet S as one example of a recording medium is housed. On a downstream side of the paper feed cassette 2*a* in a paper sheet conveyance direction, i.e., on a left upper side of the paper feed cassette 2*a* in FIG. 1, a paper feed device 3*a* is disposed. By the paper feed device 3*a*, the paper sheet S is fed out one by one separately toward the left upper side of the paper feed cassette 2*a* in FIG. 1.

Furthermore, the printer 100 is provided inside thereof with a first paper sheet conveyance path 4*a*. With respect to the paper feed cassette 2*a*, the first paper sheet conveyance path 4*a* is positioned on the left upper side, which is a paper feed direction of the paper feed cassette 2*a*. The paper sheet S, after having been fed out from the paper feed cassette 2*a*, is conveyed, via the first paper sheet conveyance path 4*a*, perpendicularly upward along a side surface of the printer main body 1.

At a downstream end of the first paper sheet conveyance path 4*a* with respect to the paper sheet conveyance direction, a registration roller pair 13 is provided. Moreover, in immediate proximity to a downstream side of the registration roller pair 13 in the paper sheet conveyance direction, a first belt conveyance portion 5 and a recording portion 9 are disposed. The paper sheet S, after having been fed out from the paper feed cassette 2*a*, passes through the first paper sheet conveyance path 4*a* to reach the registration roller pair 13. While correcting oblique feeding of the paper sheet S, the registration roller pair 13 feeds out the paper sheet S toward the first belt conveyance portion 5 in synchronization with timing at which the recording portion 9 executes an ink discharge operation.

Furthermore, in order to prevent poor ink discharge due to drying or clogging of a recording head, at the start of printing after a long-term suspension, from all discharge nozzles of recording heads, and in an interim between printing operations, from any of the discharge nozzles that has an ink discharge amount of not more than a set value, the recording portion 9 executes purge in which part of ink in the nozzles that has increased in viscosity is pushed out, whereby preparation for a next printing operation is performed.

On a downstream side of the first belt conveyance portion 5 with respect to the paper sheet conveyance direction (on a right side in FIG. 1), a second belt conveyance portion 12 is disposed. The paper sheet S, after an ink image has been recorded thereon at the recording portion 9, is sent to the second belt conveyance portion 12 at which while the paper sheet S passes therethrough, ink discharged onto a surface of the paper sheet S becomes dried.

On a downstream side of the second belt conveyance portion 12 with respect to the paper sheet conveyance direction near a right side surface of the printer main body 1, a de-curler portion 14 is provided. The paper sheet S, after the ink thereon has become dried at the second belt conveyance portion 12, is sent to the de-curler portion 14 at which curl generated in the paper sheet S is corrected.

On a downstream side of the de-curler portion 14 with respect to the paper sheet conveyance direction (on an upper side in FIG. 1), a second paper sheet conveyance path 4*b* is provided. In a case of not performing double-sided recording, the paper sheet S, after having passed through the de-curler portion 14, is ejected from the second paper sheet conveyance path 4*b* onto a paper sheet ejection try 15 that is provided at an outer portion of the right side surface of the printer 100.

At an upper portion in the printer main body 1 above the recording portion 9 and the second belt conveyance portion 12, a reverse conveyance path 16 for performing double-sided recording is provided. In a case of performing double-sided recording, the paper sheet S, after recording on a first side thereof has been completed and having passed through the second belt conveyance portion 12 and the de-curler portion 14, is sent through the second paper sheet conveyance path 4*b* to the reverse conveyance path 16. The paper sheet S, after having been sent to the reverse conveyance path 16, subsequently has its conveyance direction switched for recording on a second side thereof, thus being sent toward a left side through the upper portion in the printer main body 1, and further passes through the first paper sheet conveyance path 4*a* and the registration roller pair 13 to be sent, with the second side thereof facing upward, again to the first belt conveyance portion 5.

Furthermore, on a lower side of the second belt conveyance portion 12, a wipe unit 19 and a cap unit 30 are disposed. At a time of executing the aforementioned purge, the wipe unit 19 moves horizontally to a lower side of the recording portion 9 to wipe off ink discharged from the discharge nozzles of the recording heads and collect the ink thus wiped off. At a time of capping an ink discharge surface of each of the recording heads, the cap unit 30 moves horizontally to the lower side of the recording portion 9 and further moves upward to be mounted to a lower surface of each of the recording heads.

Figure 2:
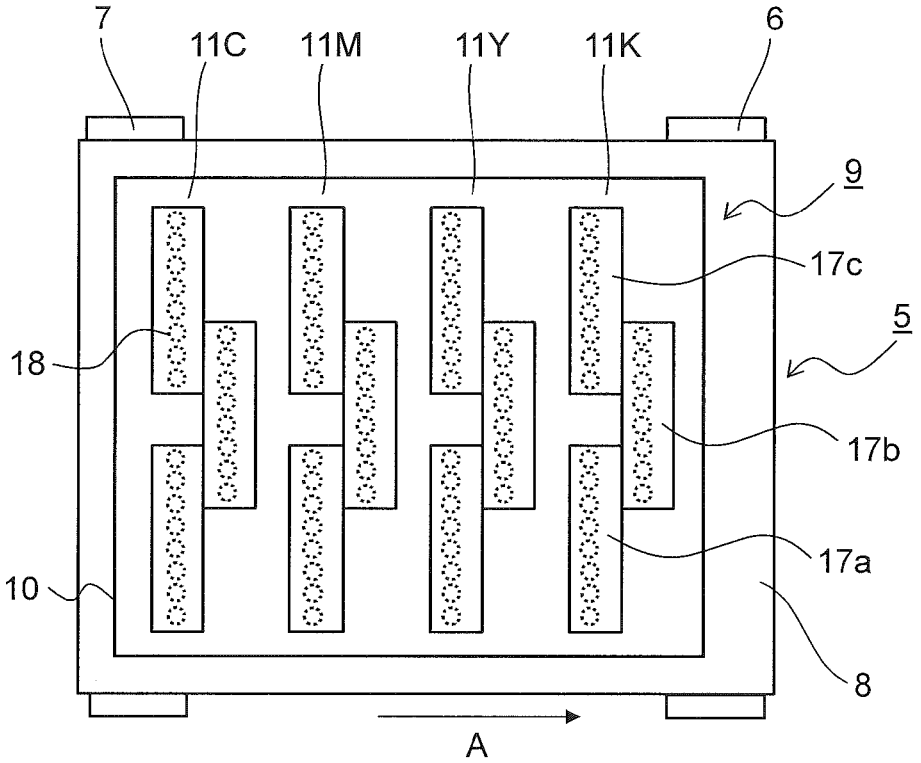
FIG. 2 is a diagram, as viewed from above, of a first conveyance unit and a recording portion of the ink-jet recording apparatus shown in FIG. 1.
Figure 3:
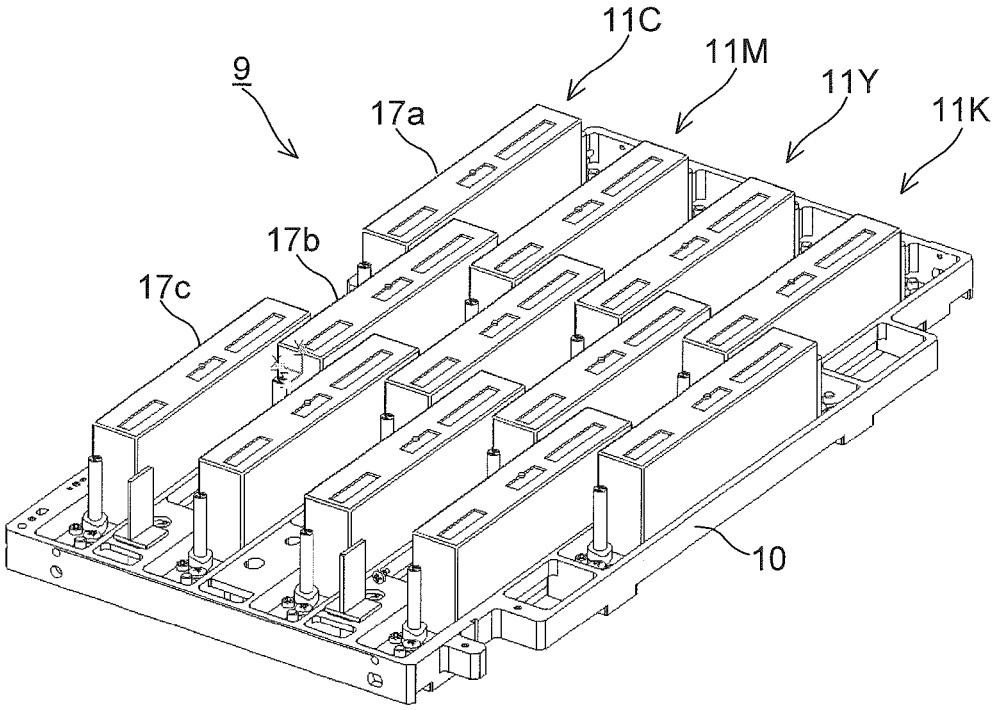
FIG. 3 is a diagram of the recording portion as viewed from obliquely above.

As shown in FIG. 2 and FIG. 3, the recording portion 9 includes a head housing 10 and line heads 110, 11M, 11Y, and 11K that are held by the head housing 10. The line heads 110 to 11K are supported at such a height that a prescribed spacing (for example, 1 mm) is formed with respect to a conveyance surface of a first conveyance belt 8 that is stretched around a plurality of rollers including a driving roller 6 and a driven roller 7, and a plurality of (herein, three) recording heads 17*a* to 17*c* are arranged in a staggered pattern along a paper sheet width direction (a top-bottom direction in FIG. 2) orthogonal to the paper sheet conveyance direction.

Figure 4:
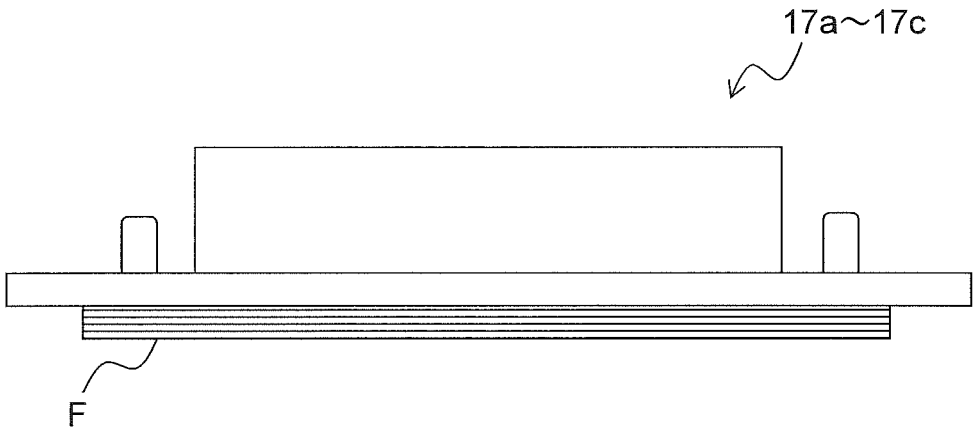
FIG. 4 is a diagram of a recording head as a component of a line head of the recording portion.
Figure 5:
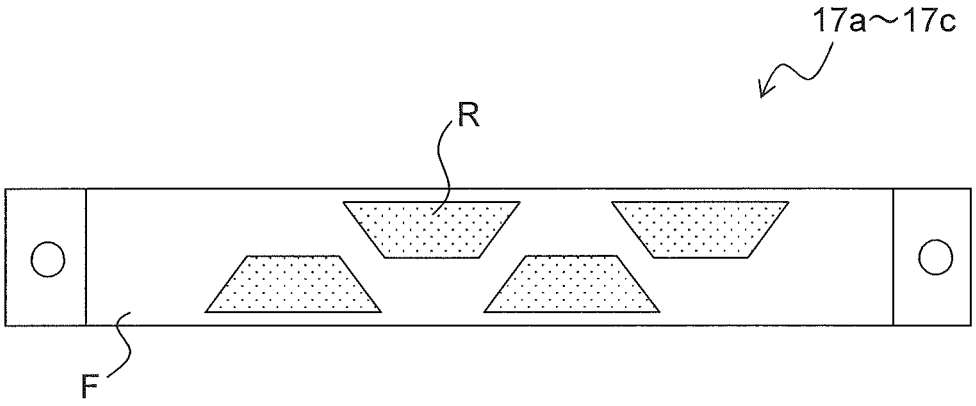
FIG. 5 is a diagram of the recording head as viewed from an ink discharge surface side.

As shown in FIG. 4 and FIG. 5, on an ink discharge surface F of each of the recording heads 17*a* to 17*c*, there is provided a nozzle region R in which a multitude of discharge nozzles 18 (see FIG. 2) are arranged. Since the recording heads 17*a* to 17*c* have the same shape and configuration, FIG. 4 and FIG. 5 show a single recording head to represent each of the recording heads 17*a* to 17*c*.

The recording heads 17*a* to 17*c* constituting each of the line heads 110 to 11K are supplied with ink of a corresponding one of four colors (cyan, magenta, yellow, and black) retained in ink tanks (not shown), respectively, depending on respective colors of the line heads 110 to 11K.

Based on a control signal from a control portion 110 (see FIG. 1), in accordance with image data received from an external computer, each of the recording heads 17*a* to 17*c* discharges ink from the discharge nozzles 18 toward the paper sheet S being conveyed while being suction-held onto the conveyance surface of the first conveyance belt 8. In this way, on the paper sheet S on the first conveyance belt 8, a color image is formed in which the four colors, which are cyan, magenta, yellow, and black, of ink are superimposed on one another.

Furthermore, in order to prevent poor ink discharge due to drying or clogging of the recording heads 17*a* to 17*c*, at the start of printing after a long-term suspension, from all the discharge nozzles 18 of the recording heads 17*a* to 17*c*, and in an interim between printing operations, from any of the discharge nozzles 18 of the recording heads 17*a* to 17*c* that has an ink discharge amount of not more than a set value, purge is executed in which part of ink in the discharge nozzles 18 that has increased in viscosity is pushed out, whereby preparation for a next printing operation is performed.

Furthermore, at one end portion of the ink discharge surface F of each of the recording heads 17*a* to 17*c*, a hydrophilic member 20 (see FIG. 16) having high hydrophilicity compared with that of the nozzle region R is attached. The hydrophilic member 20 is formed of, for example, a SUS plate of 50 to 100 μm in thickness, and a contact angle (not more than about 90 degrees) of the hydrophilic member 20 with respect to water is smaller by not less than about 20 degrees than a contact angle (about 110 degrees) of the nozzle region R with respect to water. Furthermore, the hydrophilic member 20 has a portion that protrudes outward from the ink discharge surface F, and the protruding portion is bent upward to form an inclined surface 20*a*. The inclined surface 20*a* is bent into an angle of, for example, about 60 degrees with respect to the ink discharge surface F.

Figure 6:
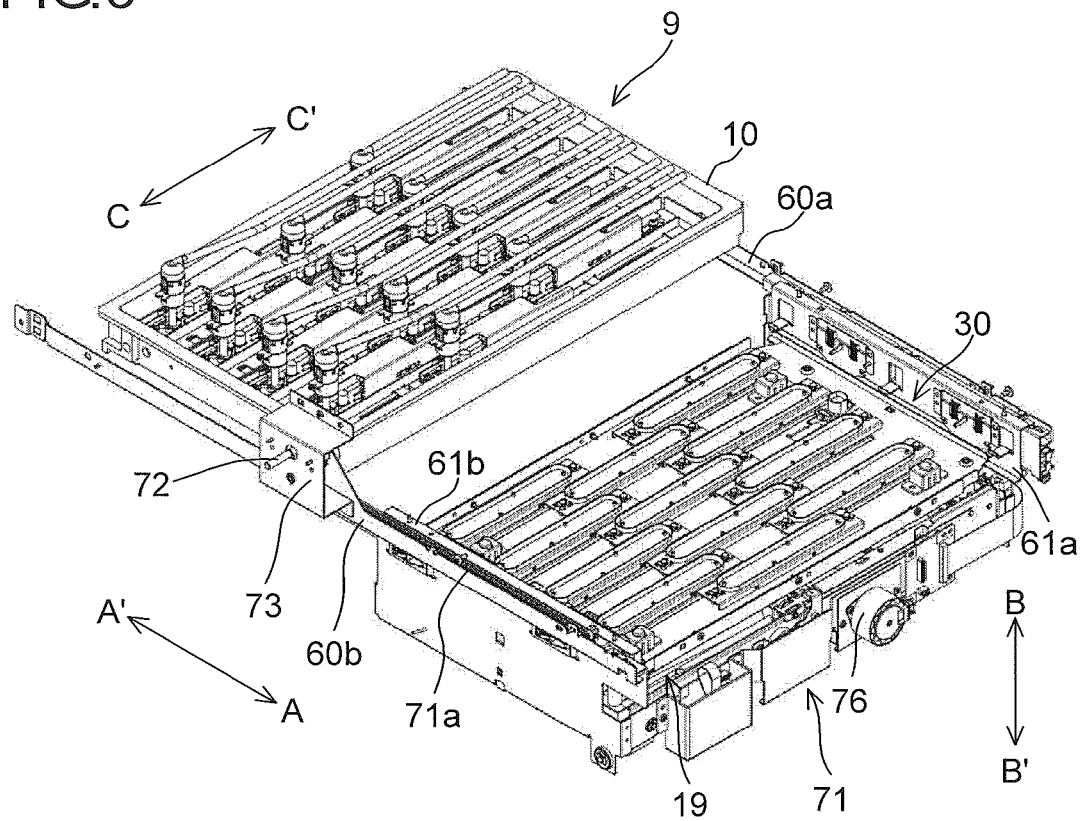

As shown in FIG. 6, on the lower side of the recording portion 9, two guide rails 60*a* and 60*b* are fastened along both end portions thereof parallel to the paper sheet conveyance direction (arrow A direction). A pair of guide plates 61*a* and 61*b* are fastened to the guide rails 60*a* and 60*b*, respectively, and side end edges of the cap unit 30 are supported to lower end portions of the guide plates 61*a* and 61*b*, respectively. Furthermore, a carriage 71 is slidably supported to the guide rails 60*a* and 60*b*, and the wipe unit 19 is placed on the carriage 71.

The cap unit 30 is capable of reciprocating between a position directly underneath the recording portion 9 and a position (a position shown in FIG. 6) retracted in a horizontal direction (arrow A direction) from that position (the position directly underneath the recording portion 9) and is configured to move upward at the position directly underneath the recording portion 9 to cap the recording heads 17*a* to 17*c*.

Figure 7:
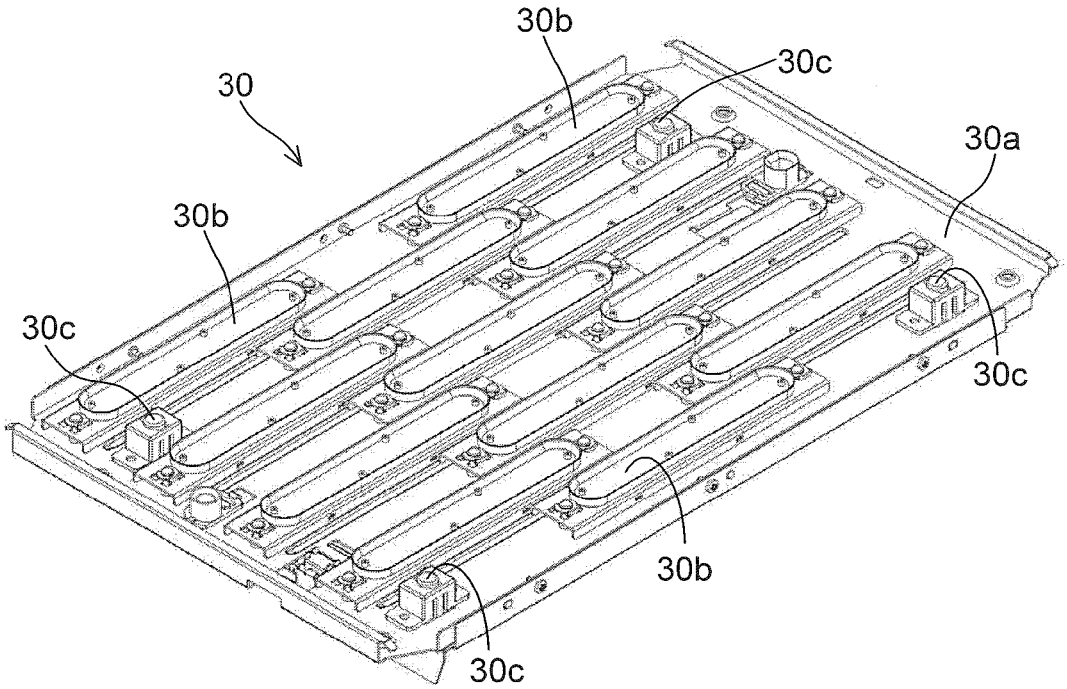
FIG. 7 is a diagram showing a structure of the cap unit.

To be specific, as shown in FIG. 7, the cap unit 30 includes a cap tray 30*a* made of sheet metal, 12 concave cap portions 30*b* that are disposed on an upper surface of the cap tray 30*a*, and four height-direction positioning protrusions 30*c*.

The cap portions 30*b* are disposed at positions corresponding to the recording heads 17*a* to 17*c*. Having this configuration, the cap unit 30 moves upward at the position directly underneath the recording portion 9 so that each of the cap portions 30*b* caps the ink discharge surface F of each of the recording heads 17*a* to 17*c*. When the cap unit 30 is caused to ascend to a recording portion 9 side to cap the recording heads 17*a* to 17*c*, the height-direction positioning protrusions 30*c* come in contact with the housing 10 of the recording portion 9 to maintain a constant contact state between each of the cap portions 30*b* and the ink discharge surface F.

As shown in FIG. 6, the wipe unit 19 is capable of reciprocating between a position directly underneath the recording portion 9 and a position retracted in the horizontal direction (arrow A direction) from that position (the position directly underneath the recording portion 9) and is configured to move upward at the position directly underneath the recording portion 9 to perform an after-mentioned wiping operation.

To be specific, on an outer side of the guide rail 60*b*, a drive motor 72 for driving the carriage 71 to move in an arrow A-A' direction, a gear train (not shown) that engages with the drive motor 72 and rack teeth 71*a* of the carriage 71, and a cover member 73 that covers the drive motor 72 and the gear train are mounted. The drive motor 72 rotates forwardly to cause the gear train to rotate, and thus the carriage 71 and the wipe unit 19 move from the retracted position (the position shown in FIG. 6) to the position directly underneath the recording portion 9. The drive motor 72, the gear train, and so on constitute a wipe movement mechanism that causes the wipe unit 10 to move in the horizontal direction.

Figure 8:
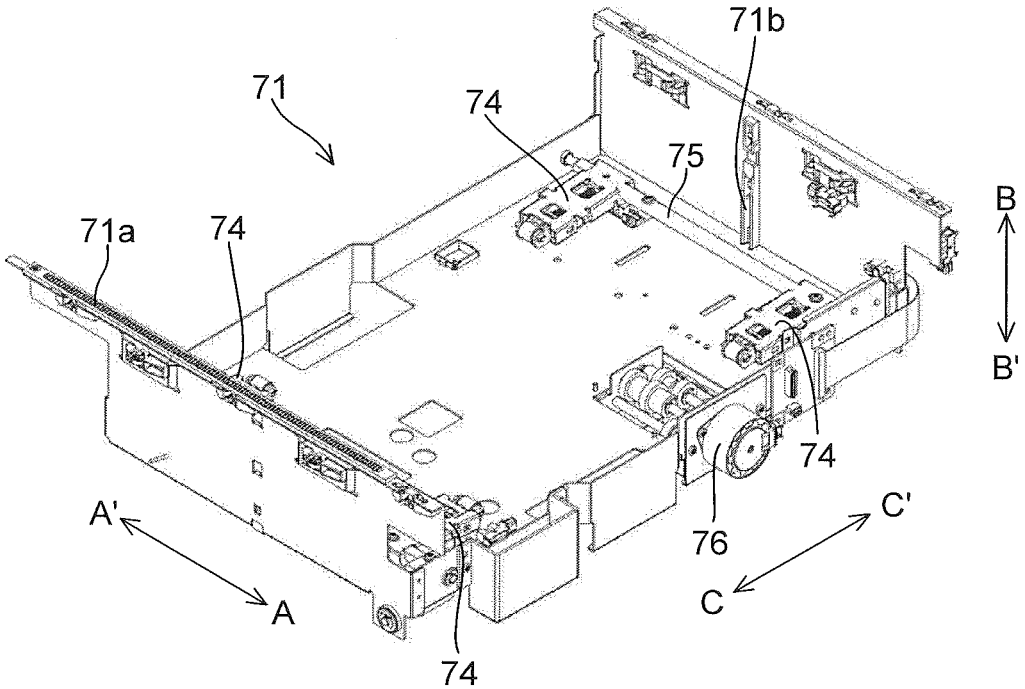
FIG. 8 is a diagram showing a structure of a carriage.
Figure 9:
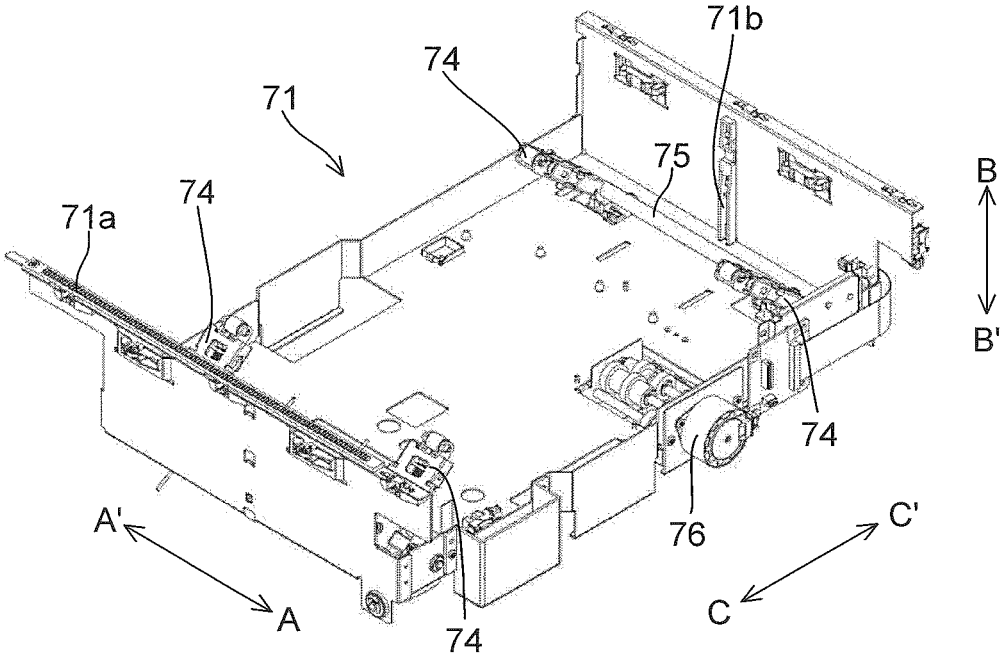
FIG. 9 is a diagram showing a structure of the carriage.

Furthermore, as shown in FIG. 8 and FIG. 9, at each of four corners of the carriage 71, there is provided a support arm 74 that supports the wipe unit 19 from a lower surface side thereof and is capable of swinging (standing up or lying flat). Two in each pair of the support arms 74 adjacent to each other in the arrow A-A' direction are connected to each other by a rotary shaft 75. Furthermore, on an outer side of the carriage 71, a wipe ascending/descending motor 76 for causing the support arm 74 to swing and a gear train and so on (not shown) that engage with the wipe ascending/descending motor 76 and a gear of the rotary shaft 75 are mounted. The wipe ascending/descending motor 76 rotates forwardly to cause the gear train and so on to rotate, and thus the rotary shaft 75 is caused to move circularly to cause the support arm 74 to swing (stand up). As a result of this, the wipe unit 19 ascends. The wipe ascending/descending motor 76, the gear train, the rotary shaft 75, the support arm 74, and so on constitute a wipe ascending/descending mechanism that causes the wipe unit 19 to move in an up-down direction (arrow B-B' direction). Furthermore, on an inner surface of the carriage 71, a guide groove 71*b* is formed that extends in the up-down direction, and the wipe unit 19 ascends/descends along the guide groove 71*b*.

Figure 10:
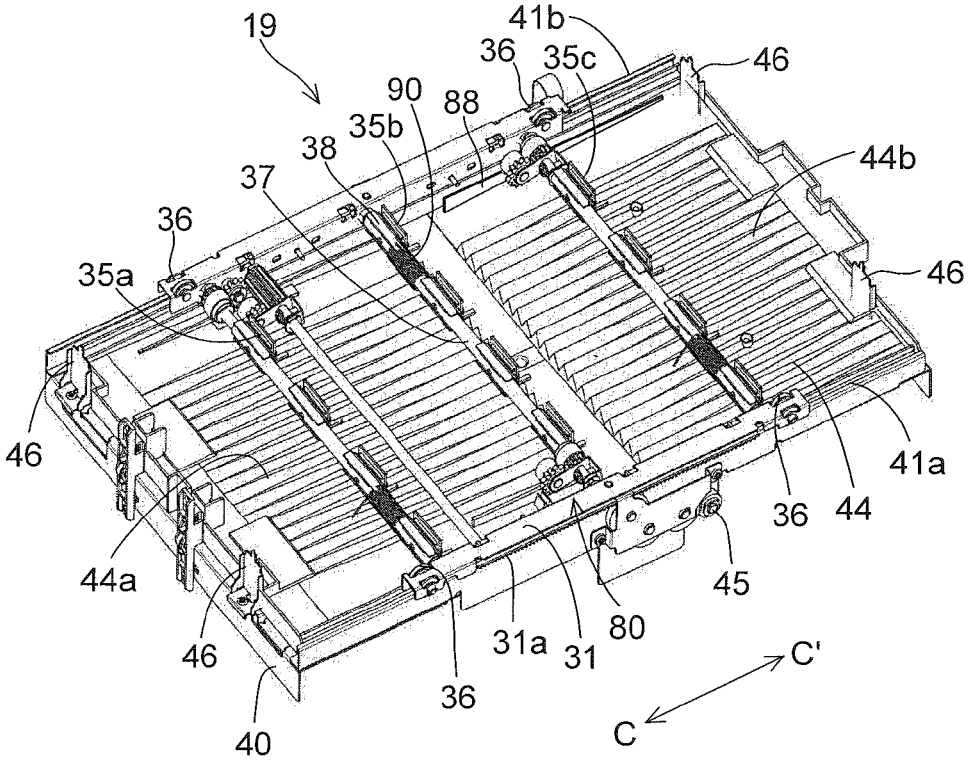
FIG. 10 is a diagram showing a structure of the wipe unit.

As shown in FIG. 10, the wipe unit 19 is composed of a substantially rectangular wiper carriage 31 to which a plurality of wipers 35*a* to 35*c* are fastened and a support frame 40 that supports the wiper carriage 31.

At opposed end edges of an upper surface of the support frame 40, rail portions 41*a* and 41*b* are formed, respectively, and rollers 36 that are provided at four corners of the wiper carriage 31 come in contact with the rail portions 41*a* and 41*b*, so that the wiper carriage 31 is supported so as to be slidable in an arrow C-C' direction with respect to the support frame 40.

On an outer side of the support frame 40, a wiper carriage moving motor 45 for causing the wiper carriage 31 to move in a horizontal direction (arrow C-C' direction) and a gear train (not shown) that engages with the wiper carriage moving motor 45 and rack teeth 31*a* of the wiper carriage 31 are mounted. The wiper carriage moving motor 45 rotates forwardly/reversely to cause the gear train to rotate forwardly/reversely, and thus the wiper carriage 31 reciprocates in the horizontal direction (arrow C-C' direction). The wiper carriage moving motor 45, the gear train, the rack teeth 31*a*, and so on constitute a drive mechanism that causes each of the wipers 35*a* to 35*c* to move along the ink discharge surface F of a corresponding one of the recording heads 17*a* to 17*c*.

Each of the wipers 35*a* to 35*c* is an elastic member (for example, a member made of rubber such as EPDM) for wiping off ink pushed out from the discharge nozzles 18 of the recording heads 17*a* to 17*c*. From a substantially perpendicular direction, each of the wipers 35*a* to 35*c* is brought in press-contact with a wipe-off start position on an outer side of the nozzle region R (see FIG. 5) to which the discharge nozzles 18 are exposed and, by movement of the wiper carriage 31, is caused to wipe the ink discharge surface F including the nozzle region R in a prescribed direction (the arrow C-C' direction in FIG. 10).

Four wipers 35*a* are disposed at a substantially equal spacing from each other, and similarly, four wipers 35*b* and four wipers 35*c* are disposed also at a substantially equal spacing from each other, respectively. The wipers 35*a* and 35*c* are disposed at positions corresponding to the recording heads 17*a* and 17*c* on left and right sides (see FIG. 3) as components of the line heads 110 to 11K, respectively. Furthermore, the wipers 35*b* are disposed at positions corresponding to the recording heads 17*b* at a center (see FIG. 3) as components of the line heads 110 to 11K and are fastened so as to be shifted by a prescribed distance in a direction orthogonal to a movement direction (arrow C-C' direction) of the wiper carriage 31 with respect to the wipers 35*a* and 35*c*.

At each of four locations on the upper surface of the support frame 40, a height-direction positioning protrusion 46 is provided. When the support frame 40 is caused to ascend to the recording portion 9 side to perform an operation of wiping the ink discharge surface F of each of the recording heads 17*a* to 17*c* by the wipers 35*a* to 35*c*, the height-direction positioning protrusion 46 comes in contact with the head housing 10 of the recording portion 9 and thus maintains a constant contact state between each of the wipers 35*a* to 35*c* and the ink discharge surface F.

On the upper surface of the support frame 40, an ink collection tray 44 for collecting waste ink wiped off from the ink discharge surface F by the wipers 35*a* to 35*c* is disposed. At a substantially center portion of the ink collection tray 44, an ink ejection port (not shown) is formed, and tray surfaces 44*a* and 44*b* on both sides with respect to the ink ejection port have a downward gradient toward the ink ejection port. Waste ink that has been wiped off from the ink discharge surface F by the wipers 35*a* to 35*c* and has then dropped onto the tray surfaces 44*a* and 44*b* flows toward the ink ejection port. After that, the waste ink passes through an ink collection path (not shown) that is connected to the ink ejection port, to be collected in a waste ink collection tank (not shown).

Figure 11:
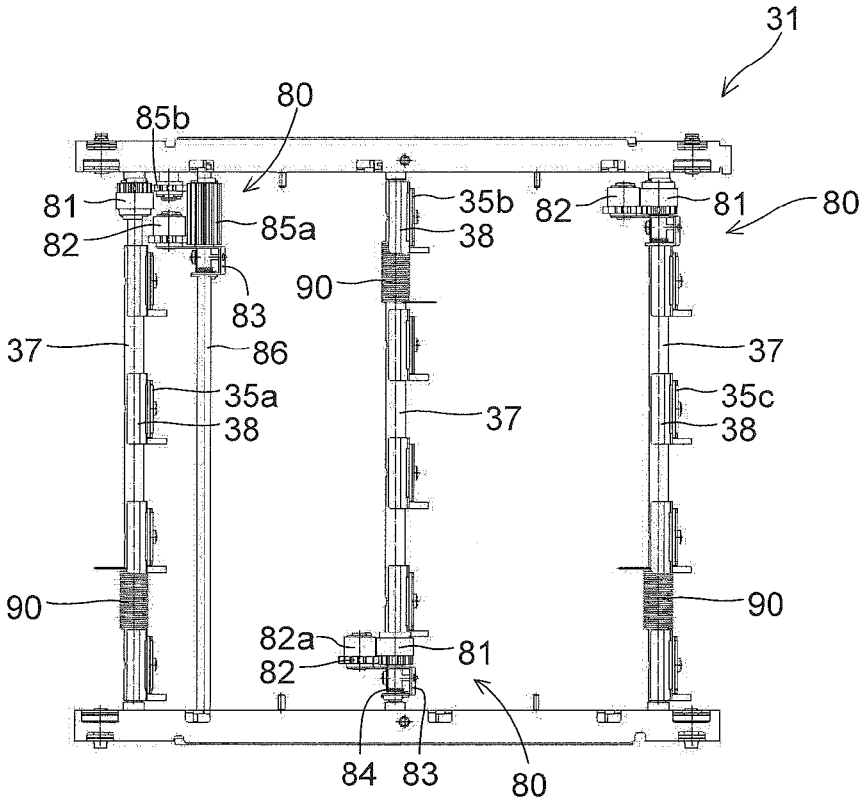
FIG. 11 is a diagram showing a structure of a wiper carriage.

Here, in this embodiment, as shown in FIG. 10 and FIG. 11, each of the wipers 35*a* to 35*c* is mounted via a wiper holding member 38 to a rotary shaft 37 as a component of the wiper carriage 31 and is capable of rotating together with the rotary shaft 37. To be specific, the wiper carriage 31 is provided with first rotary mechanisms 80 that cause the rotary shaft 37 and the wipers 35*a* to 35*c* to rotate in a clockwise direction (an arrow D direction in FIG. 21) and second rotary mechanisms 90 that cause the rotary shaft 37 and the wipers 35*a* to 35*c* to rotate in a counterclockwise direction (arrow E direction).

Figure 12:
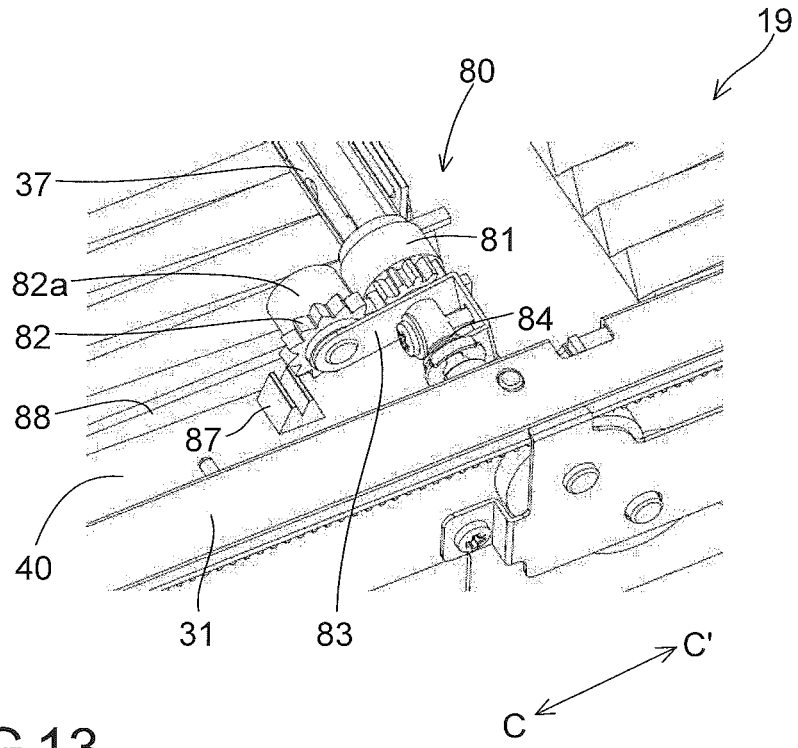
FIG. 12 is a diagram showing a structure of a vicinity of a first rotary mechanism of the wipe unit.
Figure 13:
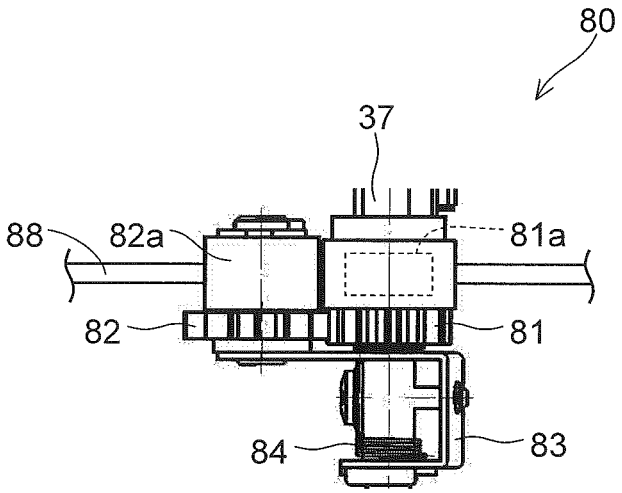
FIG. 13 is a diagram showing a structure of the vicinity of the first rotary mechanism of the wipe unit.

As shown in FIG. 12, the first rotary mechanism 80 includes a one-way gear 81, a joint gear 82, an arm 83, and a torsion spring 84 that are provided at the wiper carriage 31 and move together with the wipers 35*a*, wipers 35*b*, or wipers 35*c* in the arrow C-C' direction and a rack 87 and a gear pitch guide 88 that are provided on the upper surface of the support frame 40.

The one-way gear 81 is mounted to an end portion of the rotary shaft 37. Furthermore, the one-way gear 81 includes a built-in one-way clutch 81*a* (see FIG. 13), and when rotating in the clockwise direction (the arrow D direction in FIG. 21), the one-way gear 81 transmits a torque to the rotary shaft 37. This causes the wipers 35*a* to 35*c* to rotate also in the clockwise direction (arrow D direction). When rotating in the counterclockwise direction (the arrow E direction in FIG. 21), the one-way gear 81 does not transmit a torque to the rotary shaft 37.

The joint gear 82 is in meshing engagement with the one-way gear 81 and transmits a torque to the one-way gear 81. Furthermore, the joint gear 82 has a roller 82*a* and is fastened to the arm 83 that is mounted so as to be rotatable with respect to the rotary shaft 37. The arm 83 is biased in a counterclockwise direction (such a direction as to bring the roller 82*a* in contact with the gear pitch guide 88) by the torsion spring 84 that is mounted to the rotary shaft 37.

The rack 87 is disposed so that at a time of an after-mentioned first wipe-off operation, when each of the wipers 35*a* to 35*c* reaches a second position P2, the rack 87 engages with the joint gear 82. Thus, as will be described later, upon the joint gear 82 engaging with the rack 87 as each of the wipers 35*a* to 35*c* moves in an arrow C direction (a left direction, which is a first direction), the one-way gear 81 rotates in the clockwise direction (arrow D direction) to cause the each of the wipers 35*a* to 35*c* to rotate in the clockwise direction (arrow D direction).

Furthermore, the gear pitch guide 88 is formed to extend along a movement direction (arrow C-C' direction) of the wipers 35*a* to 35*c* so as to be in contact with the roller 82*a* of the joint gear 82. The gear pitch guide 88 performs height-direction positioning of the joint gear 82 and maintains an appropriate engagement state between the joint gear 82 and the rack 87.

As shown in FIG. 11, the second rotary mechanism 90 is formed of a torsion spring and is mounted to the rotary shaft 37. The second rotary mechanism 90 biases the rotary shaft 37 in the counterclockwise direction. Thus, as will be described later, upon the joint gear 82 and the rack 87 disengaging from each other as each of the wipers 35*a* to 35*c* moves in the arrow C direction, by a biasing force of the second rotary mechanism 90, the rotary shaft 37 and the wipers 35*a* to 35*c* rotate in the counterclockwise direction (arrow E direction). The rotary shaft 37 is provided with a regulation portion (not shown) that regulates rotation of the wipers 35*a* to 35*c* in the counterclockwise direction (arrow E direction).

As a left end one of the three first rotary mechanisms 80 shown in FIG. 11, the first rotary mechanism 80 may be configured so that two idle gears 85*a* and 85*b* are provided between the joint gear 82 and the one-way gear 81 and a rotary shaft 86 is provided to which the arm 83 and the idle gear 85*a* are mounted. By this configuration, it is possible to inhibit a size increase of the wiper carriage 31 in the arrow C-C' direction.

Next, a description is made of a recovery operation of the recording heads 17*a* to 17*c* in the printer 100 of this embodiment. The recovery operation of the recording heads 17*a* to 17*c* and a cap unit mounting operation, which will be described below, are executed by controlling, based on a control signal from the control portion 110 (see FIG. 1), respective operations of the recording heads 17*a* to 17*c*, the wipe unit 19, the drive mechanism, and so on.

Figure 14:
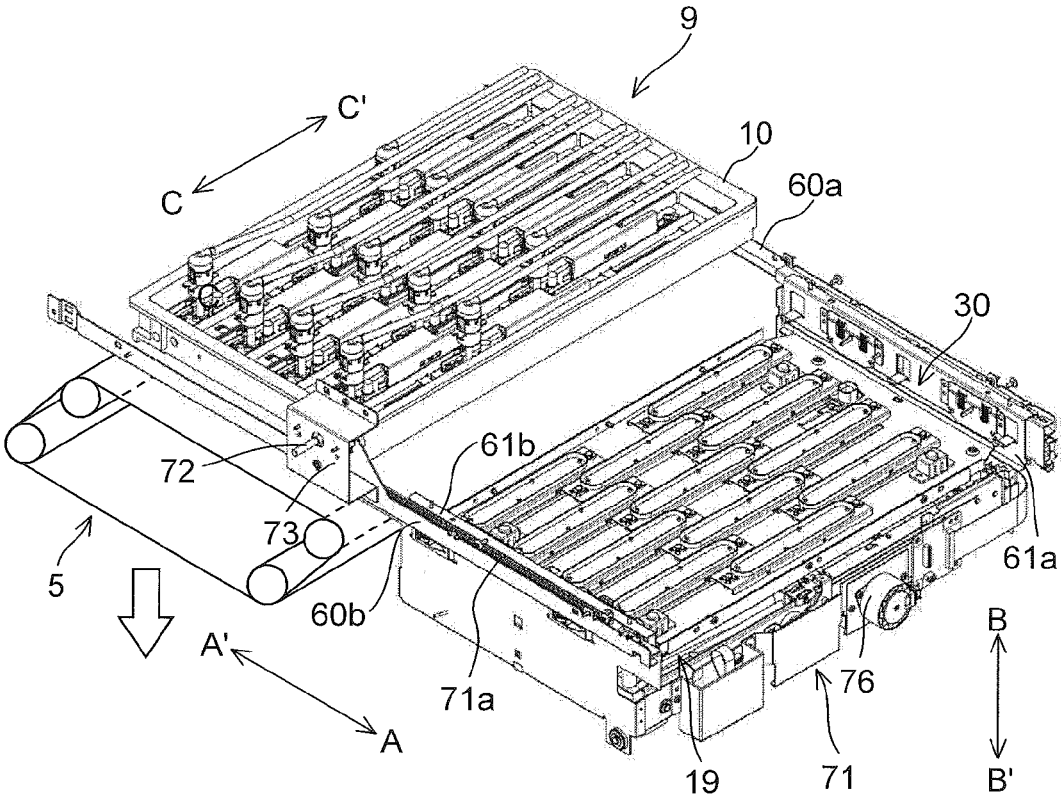
FIG. 14 is a diagram showing a state in which a first belt conveyance portion has descended.
Figure 15:
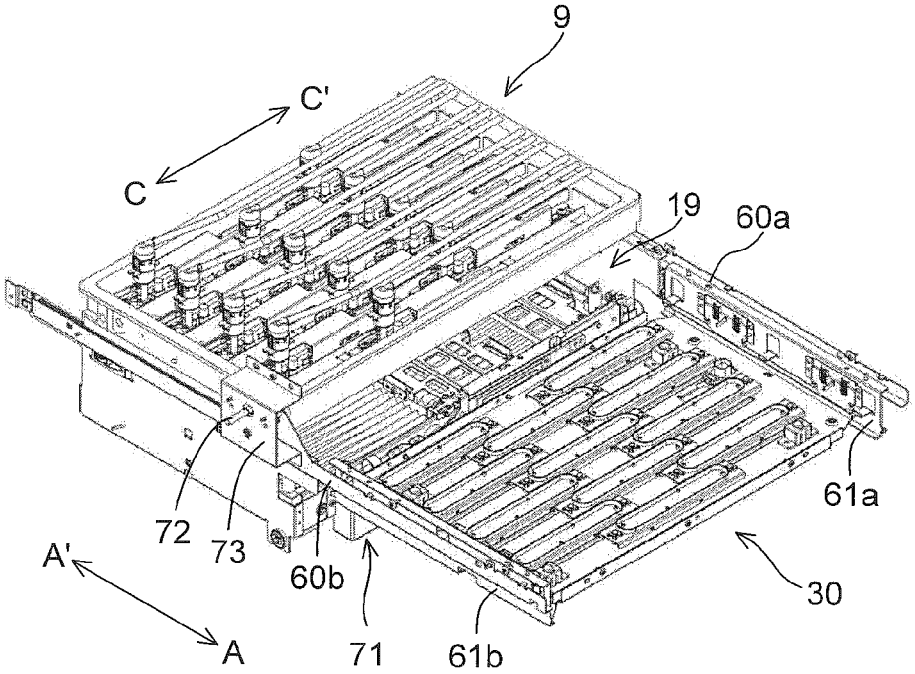
FIG. 15 is a diagram showing a state in which the wipe unit has moved to a position directly underneath the recording portion.

In a case of performing the recovery operation of the recording heads 17*a* to 17*c* by the wipe unit 19, as shown in FIG. 14, the control portion 110 controls the first belt conveyance portion 5 disposed opposite to a lower surface of the recording portion 9 to descend. Then, as shown in FIG. 15, in a state in which the cap unit 30 is left at the retracted position (the position shown in FIG. 6), the control portion 110 controls the wipe movement mechanism to cause the wipe unit 19 to move from the retracted position to the position directly underneath the recording portion 9.

(First Ink Push-Out Operation)

Figure 16:
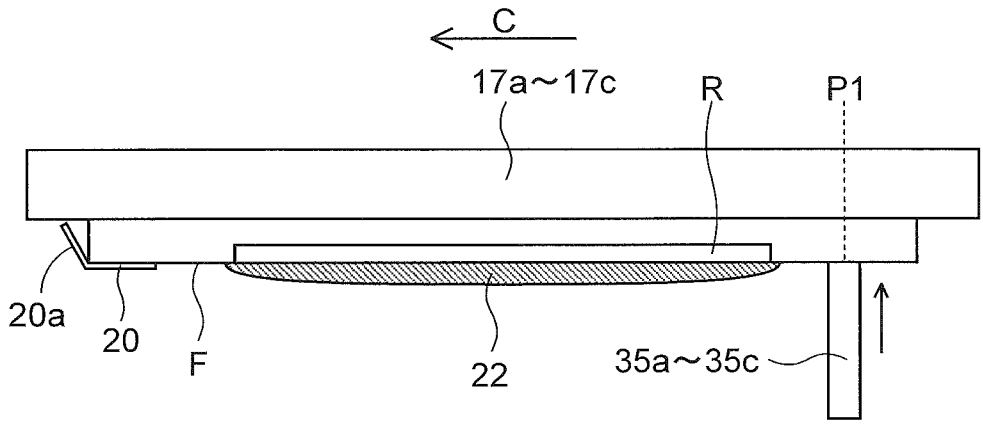
FIG. 16 is a diagram showing a state in which a wiper has been brought in press-contact with a wipe-off start position (first position) on an ink discharge surface of the recording head.
Figure 17:
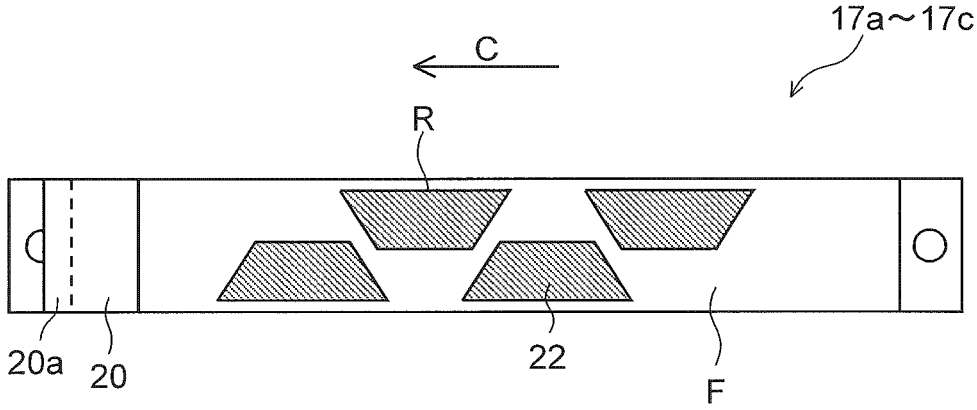
FIG. 17 is a diagram, as viewed from the ink discharge surface side, of a state in which purged ink has been pushed out onto the ink discharge surface.

Prior to a wiping operation (an after-mentioned first wipe-off operation), in a state in which printing has yet to be performed by the recording heads 17*a* to 17*c*, the recording heads 17*a* to 17*c* are supplied with ink by the control portion 110. The ink thus supplied is forcibly pushed out (purged) from the discharge nozzles 18. By this purge operation, as shown in FIG. 16, part of the ink that has increased in viscosity, a foreign object, and air bubbles in the discharge nozzles 18 are ejected, and thus the recording heads 17*a* to 17*c* can be recovered. At this time, as shown in FIG. 17, purged ink 22 is pushed out onto the ink discharge surface F along the shape of the nozzle region R in which the discharge nozzles 18 are present.

(First Wipe-Off Operation)

Next, there is performed the wiping operation of wiping off the purged ink 22 ejected onto the ink discharge surface F. To be specific, as shown in FIG. 16, the control portion 110 controls the wipe ascending/descending mechanism to cause the wipe unit 19 to ascend so that each of the wipers 35*a* to 35*c* is brought in press-contact with a first position P1 on an outer side of the nozzle region R on the ink discharge surface F of a corresponding one of the recording heads 17*a* to 17*c*.

Figure 18:
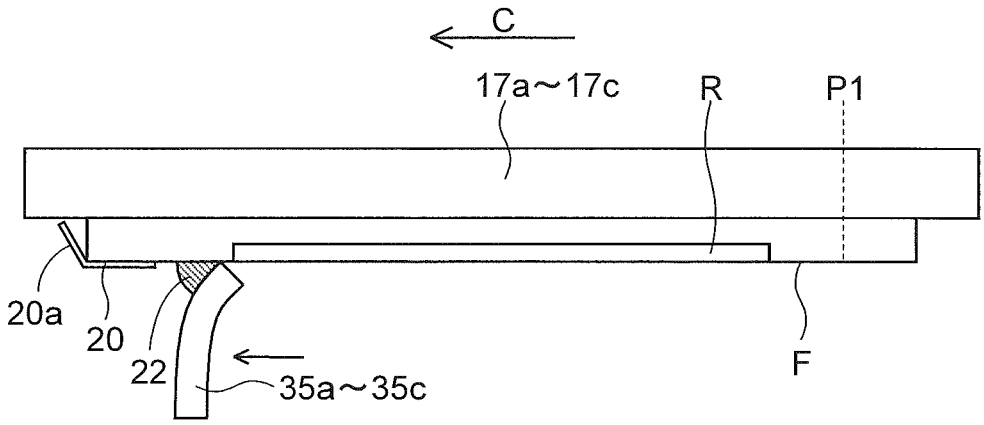
FIG. 18 is a diagram showing a state in which purged ink pushed out onto the ink discharge surface of the recording head is being wiped off by the wiper in an arrow C direction.

Then, the control portion 110 controls the wiper carriage moving motor 45 (see FIG. 10) to cause the wiper carriage 31 to move horizontally in the arrow C direction so that, as shown in FIG. 18, each of the wipers 35*a* to 35*c* wipes off the purged ink 22 discharged onto the ink discharge surface F of a corresponding one of the recording heads 17*a* to 17*c*. Waste ink that has run down from the wipers 35*a* to 35*c* is collected by the ink collection tray 44 (see FIG. 10).

(Rotary Moving-Away Operation)

Figure 19:
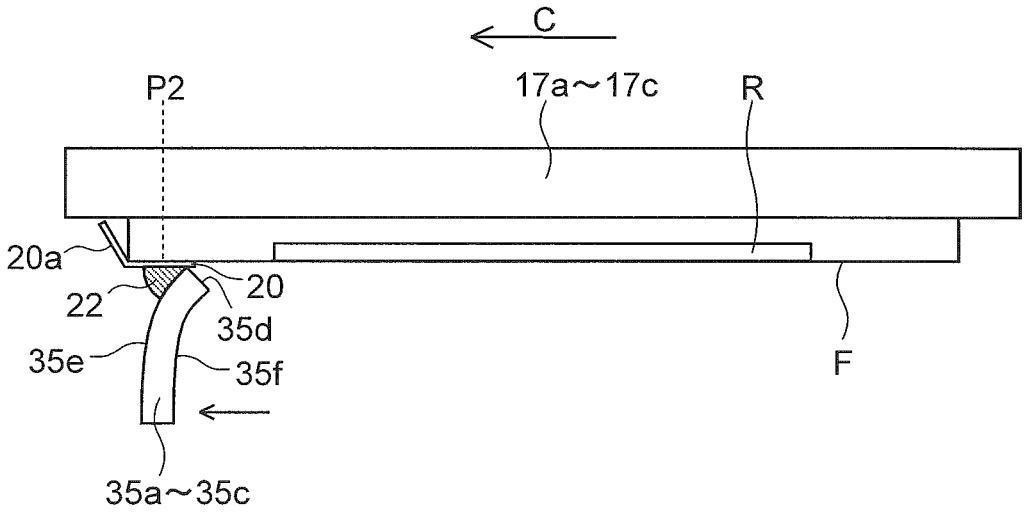
FIG. 19 is a diagram showing a state in which the wiper has reached a second position.
Figure 20:
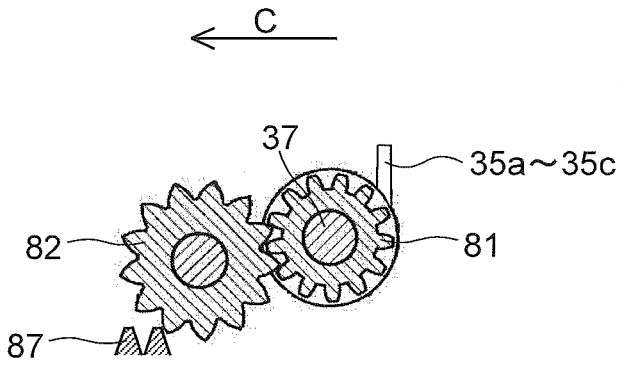
FIG. 20 is a diagram showing a state in which, during a time when the wiper is moving in the arrow C direction, a joint gear and a rack have started to engage with each other.
Figure 21:
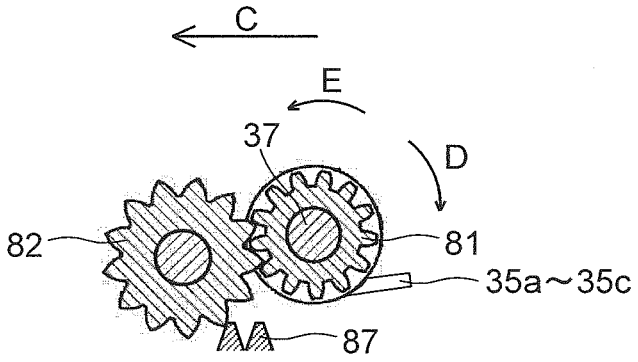
FIG. 21 is a diagram showing a state in which, during the time when the wiper is moving in the arrow C direction, the joint gear and the rack have disengaged from each other.
Figure 22:
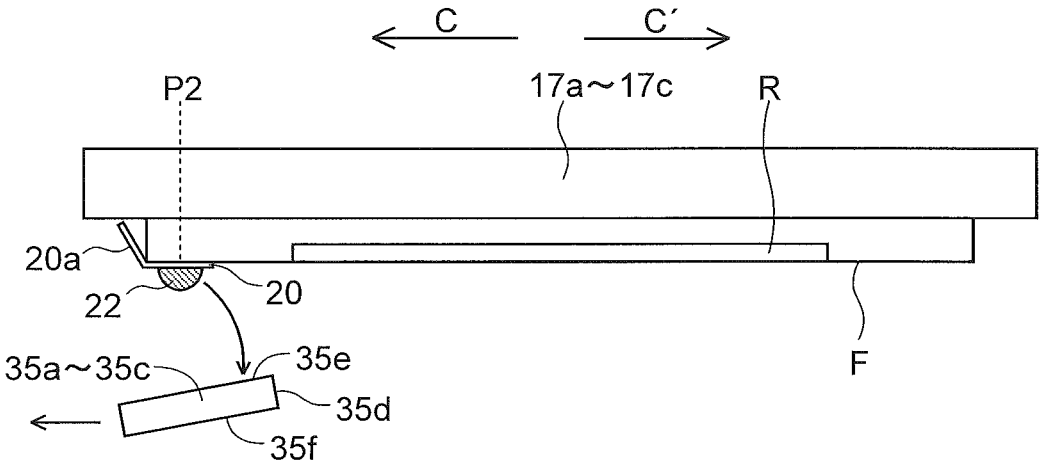
FIG. 22 is a diagram showing a state in which the wiper has rotated to move away from the ink discharge surface.

As shown in FIG. 19 and FIG. 20, upon each of the wipers 35*a* to 35*c* reaching a position (the second position P2, which is a position at which the hydrophilic member 20 is provided) on an opposite side to the first position P1 with respect to the nozzle region R on the ink discharge surface F of a corresponding one of the recording heads 17*a* to 17*c*, the joint gear 82 and the rack 87 start to engage with each other. Then, as the wipers 35*a* to 35*c* continue to move in the arrow C direction, as shown in FIG. 21, the joint gear 82 rotates in the counterclockwise direction, and the one-way gear 81 rotates in the clockwise direction (arrow D direction). At this time, due to the one-way clutch 81*a*, rotation of the one-way gear 81 is transmitted to the rotary shaft 37, and the wipers 35*a* to 35*c*, therefore, rotate in the clockwise direction (arrow D direction). That is, as shown in FIG. 22, at the second position P2, while moving in the arrow C direction, each of the wipers 35*a* to 35*c* rotates to move away from the ink discharge surface F toward an obliquely lower side in an arrow C' direction (a right direction, which is a second direction). As a result of this, the purged ink 22 adheres to the second position P2.

At a time of this rotary moving-away operation, since each of the wipers 35*a* to 35*c* moves away from the purged ink 22 toward the obliquely lower side in the arrow C' direction, it is possible to inhibit the purged ink 22 from adhering to an upper surface 35*d* and a second wipe-off surface 35*f* (a surface on an opposite side to a first wipe-off surface 35*e*, which is a surface with which the purged ink 22 is wiped off in an after-mentioned second wipe-off operation) of each of the wipers 35*a* to 35*c*. Thus, an adhesion amount of the purged ink 22 to the second position P2 is increased, and the purged ink 22, therefore, adheres thereto in a state of extending (spreading) across both end portions of the ink discharge surface F in a wiper width direction (a perpendicular direction with respect to the plane of FIG. 22).

(Reverse Rotation Operation)

Figure 23:
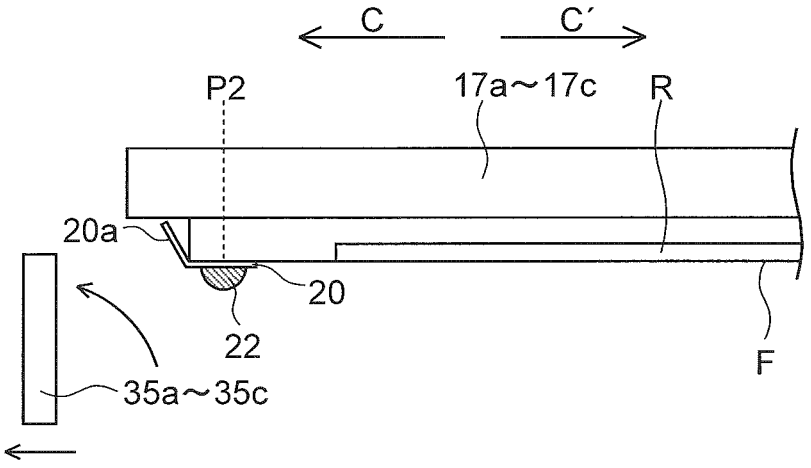
FIG. 23 is a diagram showing a state in which the wiper has returned to a state of being upright in a vertical direction.

After the rotary moving-away operation, as the wipers 35*a* to 35*c* continue to move further in the arrow C direction, the joint gear 82 and the rack 87 disengage from each other. Thus, as shown in FIG. 23, by a biasing force of the second rotary mechanism 90, the rotary shaft 37 and the wipers 35*a* to 35*c* rotate in the counterclockwise direction to return to a state in which the wipers 35*a* to 35*c* are upright in a vertical direction.

At this time, the wipers 35*a* to 35*c* are caused to rotate counterclockwise at such a position that a tip end of each of the wipers 35*a* to 35*c* does not come in contact with the purged ink 22, the ink discharge surface F, and the hydrophilic member 20. The position at which each of the wipers 35*a* to 35*c* rotates counterclockwise can be set based on the number of teeth of the rack 87 (a position of an end portion of the rack 87 in the arrow C direction), and in this embodiment, the number of teeth of the rack 87 is two. In a case where the number of teeth of the rack 87 is two, a rotation angle of the rotary shaft 37 is about 86 degrees. The number of teeth of the rack 87 may be, for example, one, in which case the rotation angle of the rotary shaft 37 is about 58 degrees. Furthermore, the number of teeth of the rack 87 may be, for example, three or more.

(Second Ink Push-Out Operation)

In a similar manner to the above-described first ink push-out operation, by the control portion 110, ink is forcibly pushed out (purged) from the discharge nozzles 18.

(Second Wipe-Off Operation)

Figure 24:
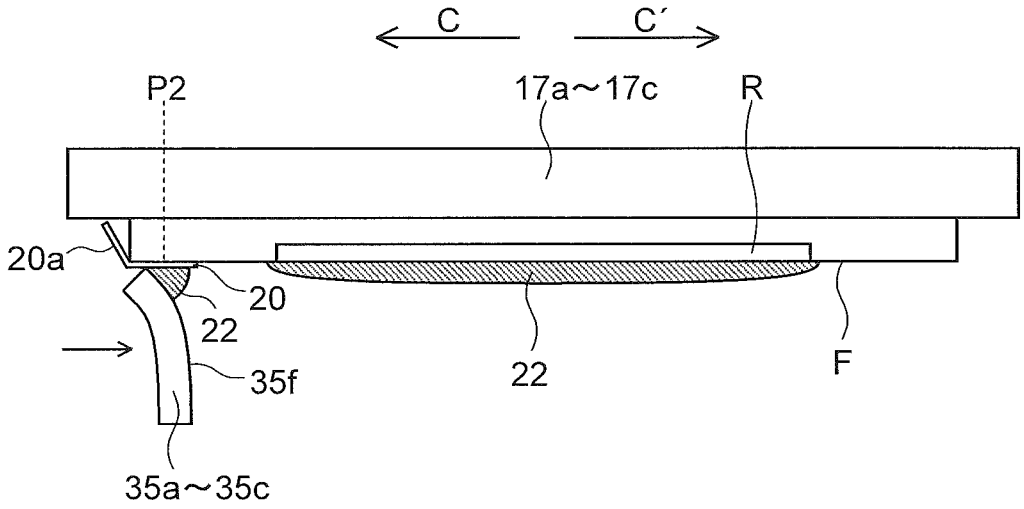
FIG. 24 is a diagram showing a state in which purged ink pushed out onto the ink discharge surface of the recording head is being wiped off by the wiper in an arrow C' direction.

Next, there is performed a wiping operation of wiping off the purged ink 22 at the second position P2 and in the nozzle region R. To be specific, the control portion 110 controls the wiper carriage moving motor 45 (see FIG. 10) to cause the wiper carriage 31 to move horizontally in the arrow C' direction so that, as shown in FIG. 24, each of the wipers 35*a* to 35*c* wipes off the purged ink 22 on the ink discharge surface F of a corresponding one of the recording heads 17*a* to 17*c*.

Figure 25:
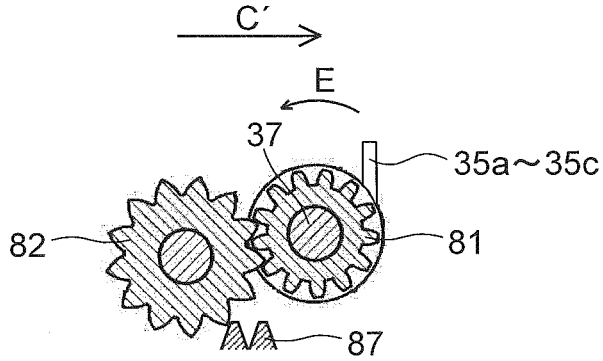
FIG. 25 is a diagram showing a state in which, during a time when the wiper is moving in the arrow C' direction, the joint gear and the rack have started to engage with each other.
Figure 26:
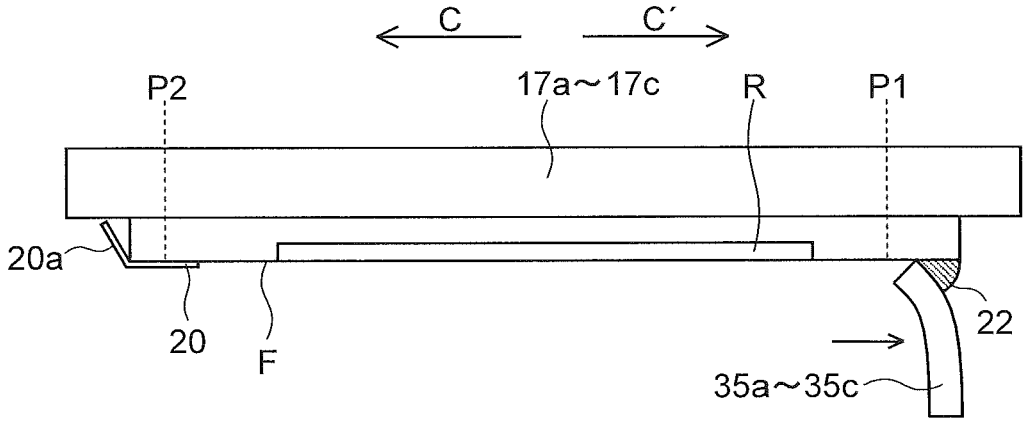
FIG. 26 is a diagram showing a state in which the wiper has reached a right end edge of the ink discharge surface.

At a time of the second wipe-off operation, when the wiper carriage 31 moves in the arrow C' direction, as shown in FIG. 25, at a prescribed position, the joint gear 82 and the rack 87 start to engage with each other. Then, the joint gear 82 rotates in the clockwise direction, and the one-way gear 81 rotates in the counterclockwise direction (arrow E direction). At this time, due to the one-way clutch 81*a*, rotation of the one-way gear 81 is not transmitted to the rotary shaft 37, and a posture of the wipers 35*a* to 35*c*, therefore, is maintained in a state of being upright in the vertical direction. Thus, the purged ink 22 at the second position P2 can be wiped off by each of the wipers 35*a* to 35*c*.

Furthermore, the inclined surface 20*a* of the hydrophilic member 20 allows each of the wipers 35*a* to 35*c* to be introduced smoothly onto the ink discharge surface F.

After that, each of the wipers 35*a* to 35*c* moves to an end edge of the ink discharge surface F (a right end edge thereof in FIG. 26) of a corresponding one of the recording heads 17*a* to 17*c*, and waste ink wiped off by the wipers 35*a* to 35*c* runs down to be collected by the ink collection tray 44 (see FIG. 10). Then, the control portion 110 controls the wipe ascending/descending mechanism to cause the wipe unit 19 to descend so that each of the wipers 35*a* to 35*c* is retracted downward from the ink discharge surface F of a corresponding one of the recording heads 17*a* to 17*c*. Lastly, the control portion 110 controls the wipe movement mechanism to cause the wipe unit 19, which is positioned between the recording portion 9 and the first conveyance unit 5, to move horizontally to underneath the cap unit 30, and to cause the first conveyance unit 5 to ascend to a prescribed position, thus completing the recovery operation of the recording heads 17*a* to 17*c*.

Next, a description is made of an operation of mounting the cap unit 30 to the recording heads 17*a* to 17*c* in the printer 100 of this embodiment.

Figure 27:
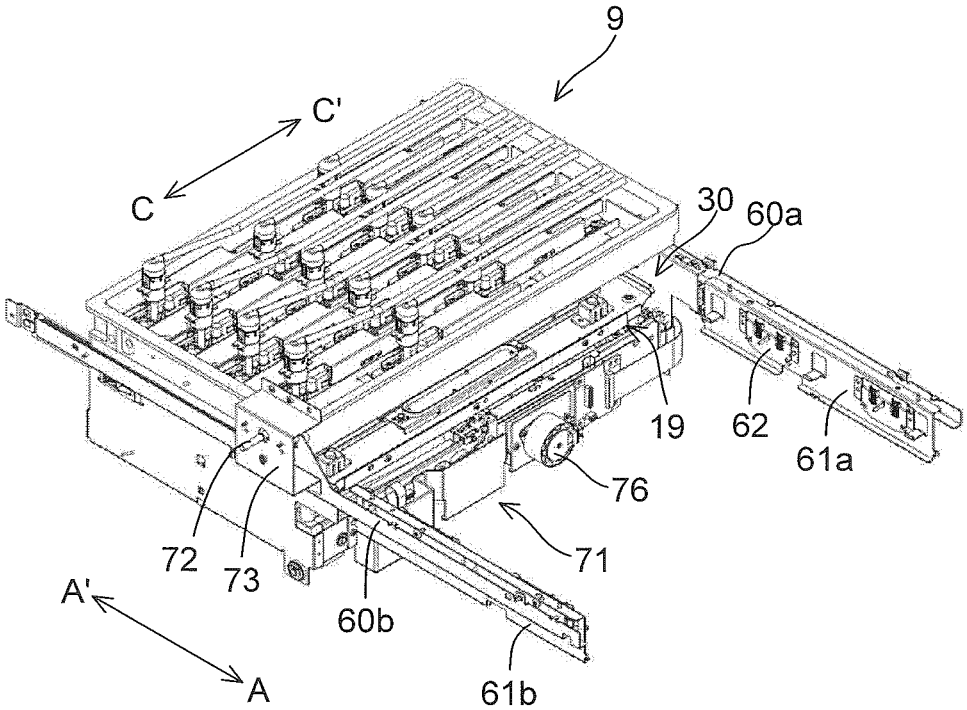
FIG. 27 is a diagram showing a state in which the cap unit and the wipe unit have moved to the position directly underneath the recording portion.

In a case of performing capping of the recording heads 17*a* to 17*c* by the cap unit 30, as shown in FIG. 14, the control portion 110 controls the first belt conveyance portion 5 disposed opposite to the lower surface of the recording portion 9 to descend. Then, as shown in FIG. 27, in a state in which the cap unit 30 is disposed over the wipe unit 19, the control portion 110 controls the wipe movement mechanism to cause the wipe unit 19 and the cap unit 30 to move from the retracted position (the position shown in FIG. 14) to the position directly underneath the recording portion 9. After that, the control portion 110 controls the wipe ascending/descending mechanism to cause the wipe unit 19 and the cap unit 30 to ascend so that the cap unit 30 is mounted to the recording heads 17*a* to 17*c*. This completes the operation of mounting the cap unit 30.

In this embodiment, as described above, after the first wipe-off operation in which, after being brought in press-contact with the first position P1 on the outer side of the nozzle region R, each of the wipers 35*a* to 35*c* is caused to move in the arrow C direction (left direction) along the ink discharge surface F to wipe off the purged ink 22, the second wipe-off operation is executed in which each of the wipers 35*a* to 35*c* is caused to move in the arrow C' direction (right direction) along the ink discharge surface F from a position on an opposite side to the nozzle region R with respect to the second position P2 to which the purged ink 22 has been made to adhere. In this way, the recovery operation of the recording heads 17*a* to 17*c* can be performed.

Furthermore, the rotary moving-away operation is executed in which, while being caused to move in the arrow C direction (left direction), each of the wipers 35*a* to 35*c* rotates to move away from the ink discharge surface F toward an obliquely lower side in the arrow C' direction (right direction). Thus, it is possible to inhibit the purged ink 22 from adhering to the upper surface 35*d* (a surface to face the ink discharge surface F) of each of the wipers 35*a* to 35*c* at a time of the rotary moving-away operation, so that an adhesion amount of the purged ink 22 to the second position P2 can be increased. The purged ink 22, therefore, can be made to adhere to the second position P2 in a state of extending (spreading) across both the end portions of the ink discharge surface F in the width direction of each of the wipers 35*a* to 35*c*, and thus it is possible to inhibit residual ink remaining without being wiped off from being generated at the end portions of the ink discharge surface F in the width direction of each of the wipers 35*a* to 35*c* in the second wipe-off operation.

Furthermore, since each of the wipers 35*a* to 35*c* rotates to move away from the ink discharge surface F, it is possible to suppress the purged ink 22 from adhering to and thus smudging the second wipe-off surface 35*f* of each of the wipers 35*a* to 35*c*. Thus, it is possible to inhibit residual ink remaining without being wiped off (ink dragging caused by ink shortage) from being generated immediately after the start of the second wipe-off operation (before each of the wipers 35*a* to 35*c* reaches the second position P2).

In a case where, instead of going through the rotary moving-away operation, each of the wipers 35*a* to 35*c* moves away to an outer side (left direction) from a left end portion of the ink discharge surface F, the each of the wipers 35*a* to 35*c* returns by resilience from a bent state to an original state, and momentum generated this time may cause the purged ink 22 to scatter in the apparatus. In this embodiment, however, since each of the wipers 35*a* to 35*c* rotates to move away from the ink discharge surface F toward an obliquely lower side in the arrow C' direction (right direction), it is possible to suppress such momentum generated when each of the wipers 35*a* to 35*c* returns from the bent state to the original state, and thus it is possible to inhibit the purged ink 22 from scattering in the apparatus.

Furthermore, each of the wipers 35*a* to 35*c* moves away from the ink discharge surface F by rotation. Thus, each of the wipers 35*a* to 35*c* comes in contact with/moves away from the ink discharge surface F without the need to cause them to move in the up-down direction, and thus it is possible to inhibit control from becoming complicated and to reduce an operation time compared with a case where each of the wipers 35*a* to 35*c* is caused to move in the up-down direction.

Even in a case where residual ink remaining without being wiped off (ink dragging caused in a case where ink remaining from a previous recovery operation has still been adhering to a tip end of any of the wipers 35*a* to 35*c*) is generated immediately after the start of the first wipe-off operation (before each of the wipers 35*a* to 35*c* reaches the nozzle region R), in the second wipe-off operation, part of the purged ink 22 that has not increased in viscosity dissolves the ink adhering to the ink discharge surface F, thus alleviating an increase in viscosity of the ink. This makes it easier for each of the wipers 35*a* to 35*c* to wipe off ink that adheres to the ink discharge surface F immediately after the start of the first wipe-off operation.

Furthermore, as described above, the first rotary mechanism 80 includes the one-way gear 81 that is mounted to the rotary shaft 37 and includes the built-in one-way clutch 81*a*, the joint gear 82 that transmits a torque to the one-way gear 81, and the rack 87 that engages with the joint gear 82. At a time of the rotary moving-away operation, the joint gear 82 engages with the rack 87 to cause the one-way gear 81 to rotate in the arrow D direction (clockwise direction), and thus a torque of the one-way gear 81 is transmitted to the rotary shaft 37 to cause the rotary shaft 37 to rotate so that each of the wipers 35*a* to 35*c* moves away from the ink discharge surface F, while at a time of the second wipe-off operation, the joint gear 82 engages with the rack 87 to cause the one-way gear 81 to rotate in the arrow E direction (counterclockwise operation), and a torque of the one-way gear 81, however, is not transmitted to the rotary shaft 37, so that each of the wipers 35*a* to 35*c* does not move away from the ink discharge surface F. Thus, the first rotary mechanism 80 can be easily configured so that at the time of the rotary moving-away operation, each of the wipers 35*a* to 35*c* is caused to rotate to move away from the ink discharge surface F, while at the time of the second wipe-off operation, each of the wipers 35*a* to 35*c* comes in contact with the ink discharge surface F.

Furthermore, the wipers 35*a* to 35*c* and the rotary shaft 37 are caused to rotate without the need to provide an electrical component such as a motor, and thus it is possible to reduce the number of components required and to inhibit control from becoming complicated. It is also possible to inhibit the purged ink 22 from adhering to such an electrical component to cause a malfunction such as a short (short circuit).

Furthermore, as described above, by providing the second rotary mechanism 90, after the rotary moving-away operation, the wipers 35*a* to 35*c* can be easily caused to rotate in the counterclockwise direction to return to an original position (posture).

The embodiment disclosed herein is to be construed in all respects as illustrative and not limiting. The scope of the invention is indicated by the appended claims rather than by the foregoing description of the embodiment, and all changes that come within the meaning and range of equivalency of the claims are intended to be embraced therein.

For example, while in the above-described embodiment, the ink push-out operation is executed prior to the first wipe-off operation, the ink push-out operation may be executed concurrently with the first wipe-off operation as long as it precedes entry of each of the wipers 35*a* to 35*c* into the nozzle region R.

Furthermore, while the above-described embodiment shows an example in which the second ink push-out operation is performed, the present disclosure is not limited thereto, and it is not required to perform the second ink push-out operation.

Furthermore, while the above-described embodiment shows an example in which the rack 87 is provided at the support frame 40, a configuration may be adopted in which the rack 87 is mountable to/demountable from the support frame 40. With this configuration, the number of teeth of the rack 87 can be easily changed. Thus, a moving distance to the left direction of each of the wipers 35*a* to 35*c* when rotating in the clockwise direction and then rotating in the counterclockwise direction to return to the original position (a duration of engagement between the joint gear 82 and the rack 87) can be easily adjusted, and thus each of the wipers 35*a* to 35*c* can be easily inhibited from coming in contact with the purged ink 22 or the ink discharge surface F at a time of moving to the left direction.

Furthermore, while the above-described embodiment shows an example in which the hydrophilic member 20 is provided in a prescribed region on the ink discharge surface F including the second position P2, it is not required to provide the hydrophilic member 20.

Furthermore, as the drive mechanism, the wipe movement mechanism, and the wipe ascending/descending mechanism, conventionally known other types of drive mechanism, movement mechanism, and ascending/descending mechanism can be used, respectively.

Furthermore, while the above-described embodiment shows an example in which the first rotary mechanism and the second rotary mechanism are configured by using a spring, a gear, a rack, and so on, the present disclosure is not limited thereto. The first rotary mechanism and the second rotary mechanism can also be configured by using a motor and so on.

Furthermore, while the above-described embodiment shows an example in which, after execution of the rotary moving-away operation, the second wipe-off operation is executed, even in a case of not executing the second wipe-off operation, a particular effect can be obtained. That is, when the rotary moving-away operation is executed at the same timing as that at which each of the wipers 35*a* to 35*c* reaches the left end portion of the ink discharge surface F (an end portion in the first direction), it is possible to inhibit the purged ink 22 from adhering to (remaining on) the ink discharge surface F, and thus it is no longer necessary to execute the second wipe-off operation. Furthermore, in this case, since the rotary moving-away operation is executed, it is possible to suppress momentum generated when each of the wipers 35*a* to 35*c* returns from the bent state to the original state, and thus it is possible to obtain an effect of being able to inhibit the purged ink 22 from scattering in the apparatus.

What is claimed is:

1. A recovery system for a recording head that has a nozzle region in which a discharge nozzle that discharges ink onto a recording medium is open, comprising:

a wiper that wipes off purged ink forcibly pushed out from the discharge nozzle;

a drive mechanism that drives the wiper to reciprocate along an ink discharge surface including the nozzle region;

a first rotary mechanism that causes the wiper to rotate in such a direction as to move away from the ink discharge surface;

a control portion that controls pushing out and discharging of ink from the discharge nozzle and an operation of the drive mechanism; and a rotary shaft to which the wiper is mounted, wherein the control portion is capable of executing a recovery operation of the recording head, which includes:

an ink push-out operation in which ink is forcibly pushed out from the discharge nozzle so that purged ink adheres to the nozzle region;

a first wipe-off operation in which, after the wiper is brought in press-contact with a first position on an outer side of the nozzle region on the ink discharge surface, the wiper is caused to move, in a state of being in press-contact with the ink discharge surface, in a first direction directed toward the nozzle region along the ink discharge surface, thus wiping off the purged ink;

a rotary moving-away operation in which, at a second position on an opposite side to the first position with respect to the nozzle region on the ink discharge surface, while being caused to move in the first direction, the wiper is caused to rotate toward an obliquely lower side in a second direction opposite to the first direction, thus moving away from the ink discharge surface; and a second wipe-off operation in which, after the rotary moving-away operation, in a state of being in press-contact with the ink discharge surface, the wiper is caused to move in the second direction along the ink discharge surface from a position on an opposite side to the nozzle region with respect to the second position, thus wiping off ink at the second position, the rotary shaft extends in a perpendicular direction with respect to the first direction, the first rotary mechanism includes:

a one-way gear that is mounted to the rotary shaft and includes a built-in one-way clutch;

a joint gear that transmits a torque to the one-way gear; and a rack that engages with the joint gear through movement of the wiper to the first direction, at a time of the rotary moving-away operation, the joint gear engages with the rack to cause the one-way gear to rotate, and thus a torque of the one-way gear is transmitted to the rotary shaft to cause the rotary shaft to rotate so that the wiper moves away from the ink discharge surface, and at a time of the second wipe-off operation, the joint gear engages with the rack to cause the one-way gear to rotate in an opposite direction to that at the time of the rotary moving-away operation, and a torque of the one-way gear, however, is not transmitted to the rotary shaft, so that the wiper does not move away from the ink discharge surface.

2. The recovery system for a recording head according to claim 1, wherein a duration of engagement between the joint gear and the rack can be adjusted by changing a number of teeth of the rack.

3. The recovery system for a recording head according to claim 1, further comprising:

a second rotary mechanism that, prior to the second wipe-off operation, causes the wiper to rotate in an opposite direction to that at a time of the rotary moving-away operation.

4. An ink-jet recording apparatus comprising the recovery system for the recording head according to claim 1.

* * * * *